US006696939B2

(12) United States Patent
Schneider et al.

(10) Patent No.: US 6,696,939 B2
(45) Date of Patent: Feb. 24, 2004

(54) SIGNALING FIRE DETECTOR

(75) Inventors: Joachim Schneider, Unterhaching (DE); Anton Pfefferseder, Sauerlach-Arget (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/555,691

(22) PCT Filed: Oct. 1, 1999

(86) PCT No.: PCT/DE99/03156

§ 371 (c)(1),
(2), (4) Date: Sep. 14, 2000

(87) PCT Pub. No.: WO00/21046

PCT Pub. Date: Apr. 13, 2000

(65) Prior Publication Data

US 2003/0201899 A1 Oct. 30, 2003

(30) Foreign Application Priority Data

Oct. 2, 1998 (DE) ..... 198 45 553

(51) Int. Cl.[7] ..... G08B 23/00

(52) U.S. Cl. ..... 340/500; 340/506; 340/511; 340/517; 340/518; 340/521; 340/522; 340/3.1; 73/31.05

(58) Field of Search ..... 340/500, 506, 340/511, 517, 518, 521, 522, 628, 578, 629, 3.1; 73/31.05

(56) References Cited

U.S. PATENT DOCUMENTS

| | | | | |
|---|---|---|---|---|
| 4,088,986 A | | 5/1978 | Boucher | 340/521 |
| 4,638,443 A | | 1/1987 | Kaneyasu et al. | 702/24 |
| 4,640,628 A | | 2/1987 | Seki et al. | 374/141 |
| 4,667,106 A | | 5/1987 | Newman | 250/382 |
| 5,400,246 A | * | 3/1995 | Wilson et al. | 340/825.06 X |
| 5,486,811 A | * | 1/1996 | Wehrle et al. | 340/522 |
| 5,764,150 A | | 6/1998 | Fleury et al. | 340/632 |
| 5,774,038 A | | 6/1998 | Welch et al. | 340/286.05 |
| 5,801,633 A | | 9/1998 | Soni | 372/45 |
| 6,121,882 A | * | 9/2000 | Jaul et al. | 340/584 |
| 6,230,545 B1 | * | 5/2001 | Adolph et al. | 73/31.05 |
| 6,313,744 B1 | * | 11/2001 | Capowski et al. | 340/514 |

FOREIGN PATENT DOCUMENTS

| | | |
|---|---|---|
| DE | 197 41 335 | 3/1999 |
| DE | 198 45 553 | 4/2000 |
| EP | 0 451 719 | 10/1991 |
| EP | 0 475 884 | 3/1992 |
| EP | 0 343 037 | 7/1992 |
| GB | 2 114 286 | 8/1983 |

OTHER PUBLICATIONS

Appleby, D., Ellwood, S.H., "Volumetric fire detection using imaging of fire products and transport phenomena", AUBE 1995.

* cited by examiner

*Primary Examiner*—Daryl Pope
(74) *Attorney, Agent, or Firm*—Kenyon & Kenyon

(57) ABSTRACT

A fire detector having a sensor group containing at least one fire detection sensor and having a control and evaluation unit, which is connected to a sensor group that is set up to evaluate signals supplied by the at least one fire detection sensor, and if necessary, that is also set up to output at least one control signal for the at least one fire detection sensor. The sensor group includes one of a chemosensor and a chemosensor array, which is connected to the control and evaluation unit for evaluating a detection signal of the one of the chemosensor and the chemosensor array, and which is set up based on a chemical sensor-operation principle to detect gas emissions and/or smoke emissions associated with a fire. The additional chemosensor may be an opto-electronic gas sensor functioning on an optode basis or an optoelectronic gas sensor array functioning on an optode basis.

7 Claims, 1 Drawing Sheet

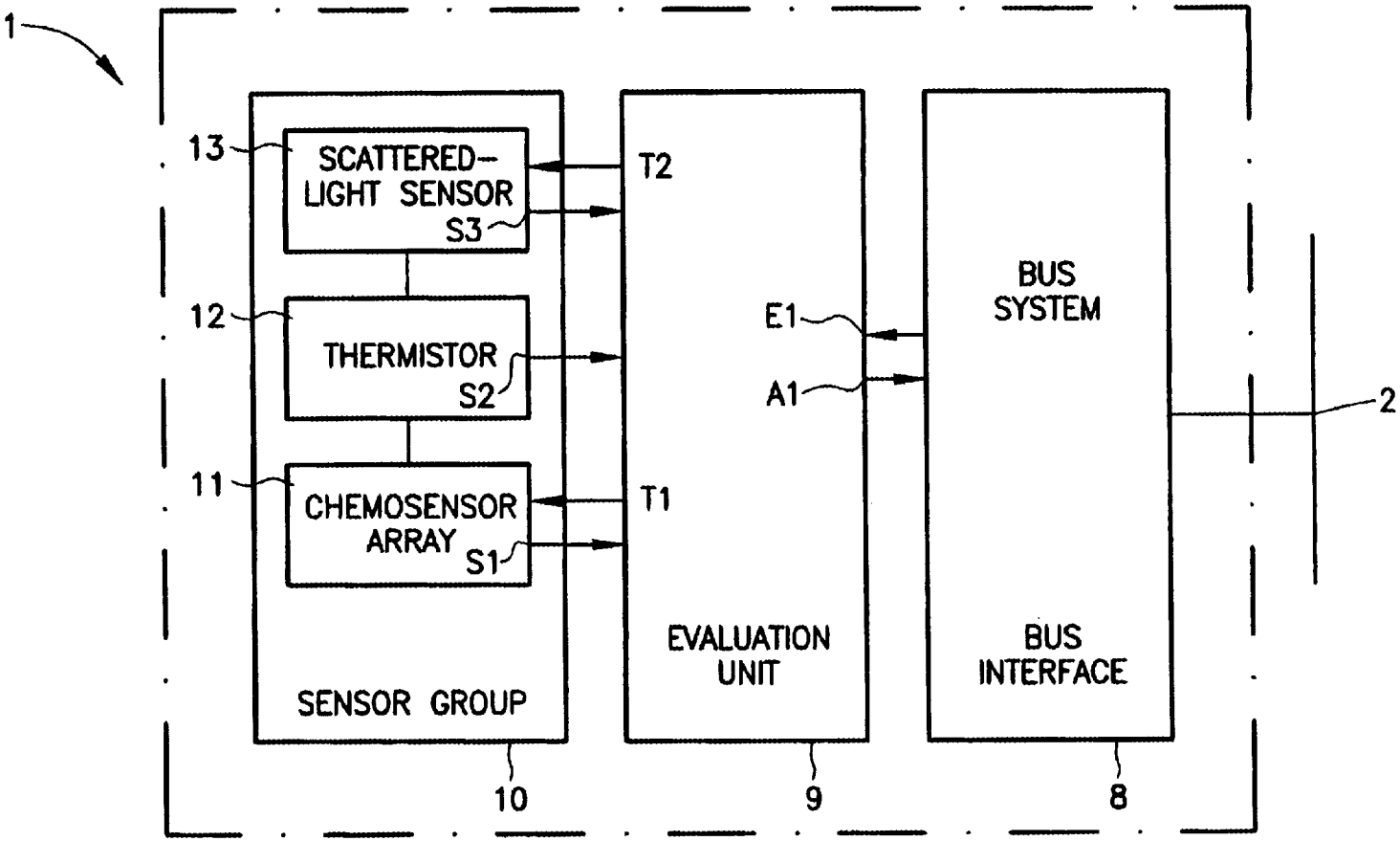
FIGURE

SIGNALING FIRE DETECTOR

FIELD OF THE INVENTION

The present invention concerns a fire detector having a sensor group, which includes at least one fire detection sensors, and having a control and evaluation device, which is connected to the sensor group, set up to evaluate the signal supplied by the at least one fire detection sensor, and if necessary, set up to output at least one control signal for the fire detection sensor(s).

BACKGROUND INFORMATION

In a fire, the burning substances undergo a material and energetic conversion. In this case, soot particles, aerosols, and gases may form in addition to the ash remaining at the center of the fire. Based on the various physical processes in the air, such as thermal diffusion and turbulences, smoke particles are formed, which are detected by the fire detectors, optical smoke detectors, and ionization detectors used today.

The response characteristics of the optical smoke detectors and ionization detectors are a function of the type of fire, and may not be equally sensitive in all types of fires. In this context, the amount and the composition of the produced smoke play a role as influence variables (quantities). Thus, fires generating a small amount of smoke may not be detected as well as fires producing a large amount of smoke. In addition, the scattered-light smoke detector is dependent on the light being reflected from the smoke particles. This may result in the response characteristics of optical smoke detectors being nonuniform in various types of fires.

The energy released in the fire leads to an increase in temperature and an emission of radiation by the flames, which is detected by heat detectors (temperature detectors) and flame detectors.

While reliability of today's fire detectors may be relatively high, single-sensor detectors may react to illusory quantities in certain situations. Due to the large number of fire detectors used, the number of false alarms attributable to them and the accompanying responses by the fire department may not be negligible. In certain application cases, conventional smoke detectors cannot be used, because either the ambient conditions are not suitable, or the fire intensity does not fall into the detection range of the detector.

Attempts may have been made in the industry to solve a part of this problem by combining certain technologies. In order to render the response characteristics of fire detectors more uniform, optical smoke detectors may be combined with an ionization detector or a temperature detector. In the planning and design of a fire detection system, the combination can mean providing various types of fire detector in one space. However, if various detection principles are already integrated in one fire detector, then a wide spectrum of possible fires can be detected by a single type of detector. An example of this is the combination of an optical smoke detector with a temperature sensor.

The gases formed during the burning of the combustible material are generally designated as combustion gases. In the starting phase of fires, CO, saturated and unsaturated hydrocarbons, alcohols, and acids are formed due to incomplete combustion. Organic materials burn as a rule, which is why CO, CO2, and H2O are the predominantly formed oxides. From approximately 200° C. on, NOx is formed in the fire from the oxygen and nitrogen in the air.

To this day, it is believed that a detection system for the gases formed in a fire is yet to be used in fire detection technology. Reference is made here to a technical article of Appleby, D. Ellwood, S. H. : "Volumetric fire detection using imaging of fire products and transport phenomena", AUBE 1995.

SUMMARY OF THE INVENTION

An object of an exemplary embodiment for the present invention is to expand the operative range (range of application) of a fire detector equipped with conventional fire detection sensors, to design its response characteristics to be more uniform, to increase the reliability (signal-to-noise ratio) of the fire detector.

In this regard, the fire detector of an exemplary embodiment of the present invention is provided with a sensor group, which has at least one fire detection sensor; and is provided with a control and evaluation unit, which is connected to the sensor group, set up for evaluating the signal supplied by the at least one fire detection sensor, and if necessary, set up for outputting at least one control signal for the fire detection sensor(s), in which the sensory group also has a chemosensor or a chemosensor array, which is likewise connected to the control and evaluation unit for evaluating the detection signal of the chemosensor or chemosensor array, and which is set up on the basis of a chemical sensor-operation principle to detect gas and/or smoke emissions caused by a fire.

This fire detector according to an exemplary embodiment of the present invention, which can either be equipped with a single sensor that is a scattered-light sensor, ionization sensor, or a temperature sensor, or can alternatively combine two sensors as well, such as, for example, a scattered-light sensor and a temperature sensor, and may include an optoelectronic gas sensor functioning on an optode basis as a chemosensor, or an optoelectronic gas sensor array functioning on an optode basis as a chemosensor.

Since, in addition to the temperature increasing, gaseous combustion products are also formed in a fire, it is believed that these can improve the performance of fire detection, i.e. increase the signal-to-noise ratio and achieve a more rapid and more uniform fire-detection sensitivity, after being detected by the chemosensor or chemosensor array additionally provided in the exemplary embodiment of the present invention. Tests have shown that both accelerated response characteristics and an increased signal-to-noise ratio can be achieved by evaluating the additional signal(s) generated by a chemosensor or chemosensor array during a fire.

An optoelectronic gas sensor that functions on an optode basis using a chemical principle of sensor operation is the subject matter of German Patent No. 197 41 335, which is assigned to Robert Bosch GmbH. With such a chemosensor, miniaturized gas sensors, i.e. the so-called optodes, may be manufactured by using an optode sensor membrane to determine a physical and/or chemical parameter of a sample substance whose light-absorption properties change, based on an indicator substance contained in the sample substance, in response to at least indirect contact with a gas and/or gas mixture to be measured.

In this case, a chemosensor membrane may be made of a gas-sensitive polymer carrier material, to which an indicator substance from the following group of compounds is added:

azobenzenes, acetophenones, corrins, porphyrins, phthalocyanines, macrolides, porphyrinogens, nonactin, valinomycin, triphenylmethanes, diphenylmethanes, antracenes, antraquinones oxazoles, and/or complexes of these compounds with transition metals of the I–II and the IV–VIII subgroups.

German Published Patent Application No. 198 45 553, which is assigned to Robert Bosch GmbH, relates to producing an optoelectronic gas sensor array, which functions on an optode basis and is in the form of a chip, and in which several photosensitive elements separated from each other, and a light transmitter centrally located among them, are integrated in or on a semiconductor substrate. The photosensitive elements are each covered by segments of the optode material, and by a segment of a reference material; the optode material is made of a gas-sensitive polymer carrier material to which a chromium ionophore (ion carrier) is added, and the reference material is made of a polymer carrier material without a chromium ion carrier.

The fire detector of an exemplary embodiment of the present invention, which uses a chemosensor as an additional detector in the fire detector, allows the fire to be detected earlier because of the higher diffusion rate of the gases formed in a fire, and allows an increase in the signal-to-noise ratio through the evaluation of the combustion gases, since at least one additional quantity detected by the chemosensor and evaluated by the control and evaluation unit is added to the quantities detected by the conventional sensors.

BRIEF DESCRIPTION OF THE DRAWING

The FIGURE shows a block diagram of the fire detector of an exemplary embodiment of the present invention.

DETAILED DESCRIPTION

The FIGURE shows a block diagram of a fire detector 1, which can be connected by a bus system 2 to a primary (master) system, in order to supply fire signals to this system and receive commands from this system. Sensor group 10 of fire detector 1 has a chemosensor or a chemosensor array 11, which may be an optoelectronic gas sensor functioning on an optode basis or an optoelectronic gas sensor array functioning on an optode basis, and which has two conventional sensors, such as, for example, a thermistor 12 and a scattered-light sensor 13 used as an optical smoke sensor.

Instead of two fire detector sensors 12, 13, fire detector 1 can alternatively have only one sensor, which is, such as, for example, a scattered-light sensor, an ionization sensor, or a temperature sensor.

Sensors 11, 12, 13 of sensory group 10 are in individual signal communication with a control and evaluation unit 9, which is set up to evaluate signals S1,S2, and S3 supplied by the respective fire detection sensor, and is set up to output control signals T1 and T2 for the fire detection sensor(s). Control and evaluation unit 9 includes a microprocessor and an analog-digital converter for converting signals S1–S3 supplied by the sensors into digital signals, and the control and evaluation unit is set up to evaluate these signals. Control and evaluation unit 9 is also connected to a bus interface 8, which includes bus-specific hardware for communicating via bus 2. The control and evaluation unit also outputs an evaluated fire detection signal Al, via bus interface 8 and bus 2, to a fire alarm receiving station not shown, and receives command and actuating signals El from this fire alarm receiving station via bus 2, e.g. for adjusting (setting) the sensor characteristics and adapting evaluating parameters. This renders fire detector 1 highly flexible.

Because described fire detector 1 according to an exemplary embodiment the present invention includes a chemosensor or a chemosensor array 11 in addition to the conventional sensor(s), i.e. in addition to exemplarily described thermistor 12 and scattered-light sensor 13, and because control and evaluation unit 9 also evaluates the signals of the chemosensor or chemosensor array, a fire can be advantageously detected in a safe and timely manner through early detection of the gases formed during the course of the fire, and because of the additional chemosensor, the fire can be detected with a higher signal-to-noise ratio than that of conventional fire detectors.

What is claimed is:

1. A fire detector comprising:

a sensor group having at least one fire detection sensor; and a control and evaluation unit connected to the sensor group evaluating signals of the at least one fire detection sensor and for outputting at least one control signal for the at least one fire detection sensor;

wherein the sensor group includes a chemosensor, the chemosensor including one of an optoelectronic gas sensor functioning on an optode basis and an optoelectronic gas sensor array functioning on an optode basis, the sensor group being connected to the control and evaluation unit for evaluating a detection signal of the chemosensor, a chemical sensor-operation of the sensor group being used to detect at least one of combustion gas emissions and smoke emissions associated with a fire.

2. The fire detector of claim 1, wherein the at least one fire detection is one fire detection sensor that is one of a scattered-light sensor, an ionization sensor and a temperature sensor.

3. The fire detector of claim 1, wherein the at least one fire detection is two fire detection sensors.

4. The fire detector of claim 3, wherein the two fire detection sensors are a temperature sensor and one of a scattered-light sensor and an ionization sensor.

5. The fire detector of claim 1, wherein the control and evaluation unit includes a microprocessor and an analog-digital converter for converting detection signals supplied by the sensor group into corresponding digital signals.

6. The fire detector of claim 5, wherein the control and evaluation unit is coupled via a bus interface to a bus system, the fire detector communicating with one of a primary system and a master system through the bus system.

7. The fire detector of claim 1, wherein the chemosensor includes at least one indicator substance having at least one chemical group selected from the group of azobenzol, acetophenone, corine, porphyrin, phthalocyanine, macrolide, porphyrinogene, nonactin, valinomycin, triphenylmethane, diphenylmethane, anthracene, anthraquinone and oxazole compounds.

* * * * *

UNITED STATES PATENT AND TRADEMARK OFFICE

CERTIFICATE OF CORRECTION

PATENT NO. : 6,696,939 B2
DATED : February 24, 2004
INVENTOR(S) : Joachim Schneider et al.

It is certified that error appears in the above-identified patent and that said Letters Patent is hereby corrected as shown below:

Column 1,
Line 6, change “sensors, and having” to -- sensor, and having --.
Line 18, change “an turbulences,” to -- and turbulence, --.

Column 2,
Line 6, change “for the present” to -- of the present --.
Line 14, change “sensor; and is” to -- sensor, and is --.
Line 65, change “antraquinones oxazoles” to -- antraquinones, oxazoles --.

Column 3,
Lines 9-10, change “a reference material; the optode” to -- a reference material. The optode --.
Lines 26-27, change “a block diagram of the fire detector of an exemplary” to -- a block diagram of an exemplary --.

Column 4,
Line 5, change “embodiment the present” to -- embodiment of the present --.

Signed and Sealed this

Twenty-eighth Day of December, 2004

JON W. DUDAS
*Director of the United States Patent and Trademark Office*